US007778561B2

(12) United States Patent
Adachi

(10) Patent No.: US 7,778,561 B2
(45) Date of Patent: Aug. 17, 2010

(54) CHARGING DEVICE FOR CHARGING CHARGE RECEIVING MATERIAL, IMAGE FORMING APPARATUS INCLUDING THE SAME, CONTROL METHOD OF THE CHARGING DEVICE AND COMPUTER-READABLE STORAGE MEDIUM RECORDING CONTROL PROGRAM FOR THE CHARGING DEVICE

(75) Inventor: Katsumi Adachi, Ikoma-gun (JP)

(73) Assignee: Sharp Kabushiki Kaisha, Osaka-shi, Osaka (JP)

( * ) Notice: Subject to any disclaimer, the term of this patent is extended or adjusted under 35 U.S.C. 154(b) by 0 days.

(21) Appl. No.: 12/216,054

(22) Filed: Jun. 27, 2008

(65) Prior Publication Data

US 2009/0003860 A1 Jan. 1, 2009

(30) Foreign Application Priority Data

Jun. 29, 2007 (JP) ..... 2007-173381

(51) Int. Cl.
*G03G 15/02* (2006.01)

(52) U.S. Cl. ..... 399/50

(58) Field of Classification Search ..... 399/89, 399/115, 168, 296, 50; 347/127–128
See application file for complete search history.

(56) References Cited

U.S. PATENT DOCUMENTS 4,783,716 A 11/1988 Nagase et al.
5,138,348 A 8/1992 Hosaka et al.
5,367,366 A 11/1994 Kido et al.
5,404,157 A * 4/1995 Hosaka et al. ..... 347/128
5,864,737 A * 1/1999 Obu et al. ..... 399/176
5,983,060 A 11/1999 Namekata et al.
2002/0102108 A1 * 8/2002 Adachi et al. ..... 399/50
2007/0059000 A1 * 3/2007 Shibuya ..... 399/44
2007/0085041 A1 * 4/2007 Hisanobu ..... 250/504 R

FOREIGN PATENT DOCUMENTS

JP 61-036782 2/1986
JP 62-141570 6/1987
JP 06-011946 1/1994
JP 08-160711 6/1996
JP 10-198124 7/1998

(Continued)

OTHER PUBLICATIONS

U.S. Appl. No. 12/163,776, filed Jun. 27, 2008.

(Continued)

*Primary Examiner*—David M Gray
*Assistant Examiner*—Billy J Lactaoen
(74) *Attorney, Agent, or Firm*—Edwards Angell Palmer & Dodge LLP

(57) ABSTRACT

In a charging device of the present invention, with reference to a state (movement speed of a charging receiving material, operating period of charging device) in which the charging device is used which state is obtained by an image formation controlling section, a voltage controlling section sets or changes an applied voltage to be applied between a discharge electrode and an inductive electrode. Accordingly, even in a case where discharge is hard to occur, a necessary amount of ions can be supplied stably.

6 Claims, 9 Drawing Sheets

FOREIGN PATENT DOCUMENTS

| | | |
|---|---|---|
| JP | 10-274892 | 10/1998 |
| JP | 11-194581 | 7/1999 |
| JP | 2001-257054 | 9/2001 |
| JP | 2002-237368 | 8/2002 |
| JP | 2003-249327 | 9/2003 |
| JP | 2003-326756 A | 11/2003 |
| JP | 2004-069860 | 3/2004 |
| JP | 2004-157447 | 6/2004 |
| JP | 2006-047641 | 2/2006 |

OTHER PUBLICATIONS

U.S. Appl. No. 12/163,776 Official Filing Receipt.

* cited by examiner

CHARGING DEVICE FOR CHARGING CHARGE RECEIVING MATERIAL, IMAGE FORMING APPARATUS INCLUDING THE SAME, CONTROL METHOD OF THE CHARGING DEVICE AND COMPUTER-READABLE STORAGE MEDIUM RECORDING CONTROL PROGRAM FOR THE CHARGING DEVICE

This Nonprovisional application claims priority under 35 U.S.C. §119(a) on Patent Application No. 173381/2007 filed in Japan on Jun. 29, 2007, the entire contents of which are hereby incorporated by reference.

FIELD OF THE INVENTION

The present invention is applied to an image forming apparatus such as a copying machine, a printer, and a facsimile. The present invention relates to a charging device that is used in an image forming process in which an electrostatic latent image that is formed on an image bearing member is developed with toner and, then, transferred and fixed onto a print medium, and to an image forming apparatus including the charging device, and the like. More specifically, the present invention relates to (i) a charging device that charges a charge receiving material (for example, a photoreceptor) or a toner image on the image bearing member (for example, a photoreceptor, or an intermediate transfer body) before transfer of the toner image onto a transfer receiving member (for example, an intermediate transfer body or recording paper) by (a) providing a discharge electrode and an inductive electrode on two sides of a dielectric body, respectively, (b) producing creeping discharge by application of an alternating voltage between the discharge electrode and the inductive electrode, and (c) extracting ions having a desired polarity, (ii) an image forming apparatus, (iii) a control method of the charging device, (iv) a control program, and (v) a computer-readable storage medium recording the control program.

BACKGROUND OF THE INVENTION

Conventionally, in an image forming apparatus that employs an electrophotographic printing method, a charging device that employs a corona discharge system has been often used in, for example, a charging device for charging a photoreceptor, a transfer device for electrostatically transferring, to recording paper or the like, a toner image which is formed on the photoreceptor or the like, and a separation device for separating the recording paper or the like which electrostatically comes into contact with the photoreceptor or the like.

Such a charging device employing the corona discharge system generally includes a shield case having an opening section that faces a charge receiving material, such as the photoreceptor and the recording paper, and a discharge electrode of a line or saw-tooth shape which discharge electrode is provided in a tensioned state in the shield case. Examples of this charging device include (a) a corotron that (i) applies a high voltage to the discharge electrode so as to generate corona discharge and, thereby, (ii) uniformly charges a charge receiving material, and (b) a scorotron that (i) applies a desired voltage to a grid electrode provided between the discharge electrode and the charge receiving material and, thereby, (ii) uniformly charges a charge receiving material, which scorotron is disclosed in Japanese Unexamined Patent Publication No. 11946/1994 (Tokukaihei 6-11946) (published on Jan. 21, 1994) (Patent Document 1).

This charging device employing the corona discharge system is used in a pre-transfer charging device for charging a toner image that has not been transferred yet to a transfer medium such as an intermediate transfer body, the recording paper, or the like. Examples of such a charging device are disclosed in Japanese Unexamined Patent Publication No. 274892/1998 (Tokukaihei 10-274892) (published on Oct. 13, 1998) (Patent Document 2) and Japanese Unexamined Patent Publication No. 69860/2004 (Tokukai 2004-69860) (published on Mar. 4, 2004) (Patent Document 3). According to techniques as disclosed in Patent Documents 2 and 3, even if a charge amount is not uniform in the toner image formed on an image bearing member, the charge amount of the toner image is uniformized before the toner image is transferred. Therefore, it becomes possible to suppress a decrease in a transfer margin at the time of transferring a toner image, and also to stably transfer the toner image to a transfer medium.

However, the conventional charging device described above has a plurality of problems. First, the charging device requires not only the discharge electrode but also the shield case, the grid electrode, and the like. Further, it is necessary to ensure a constant distance (10 mm) between the discharge electrode and the charge receiving material. As a result, a large space becomes necessary for providing the charging device. Generally, a developing device, a first transfer device, and the like are provided around a first transfer section, and the photoreceptor, a second transfer device, and the like are provided in front of a second transfer section. Accordingly, a space for the pre-transfer charging device is small. Therefore, in the conventional charging device employing the corona discharge system, it is difficult to make a layout.

Secondly, the conventional charging device employing the corona discharge system generates a large amount of discharge products such as ozone ($O_3$) and nitrogen oxide (NOx). Generation of a large amount of ozone causes (i) ozone smell, (ii) a harmful influence to a human body, (iii) deterioration of members due to strong oxidation power, and the like. Further, when nitrogen oxide is generated, nitrogen oxide as ammonium salt (ammonium nitrate) adheres to the photoreceptor. This causes a defect in an image. Especially an organic photoreceptor (OPC) that is commonly used tends to cause a defect in an image, for example, a white spot or an image deletion because of ozone, NOx or the like.

In view of uniformity of a charge amount of a toner image that has not been transferred yet, a color image forming apparatus, which employs an intermediate transfer system and includes a plurality of transfer sections, preferably has an arrangement in which the pre-transfer charging device is provided upstream with respect to each of the transfer sections (a plurality of the first transfer sections, and second transfer section). However, in practice, this is difficult in consideration of generation amounts of ozone and NOx.

Furthermore, for the purpose of eliminating ozone, in recent years, a charging device employing a contact electrification system has been used as a charging device for charging the photoreceptor itself. In the contact electrification system, a conductive roller or a conductive brush carries out contact electrification. However, according to the contact electrification system, it is difficult to carry out charging without damaging the toner image. Accordingly, the corona discharge system which is a non-contact system is used for the pre-transfer charging device. However, in a case where the pre-transfer charging device employing the conventional corona discharge system is provided to the image forming apparatus using the contact electrification system, a characteristic of being ozone free cannot be achieved.

As a technique for reducing a generation amount of ozone, for example, Japanese Unexamined Patent Publication No. 160711/1996 (Tokukaihei 8-160711) (published on Jun. 21, 1996) (Patent Document 4) discloses a charging device including: a large number of discharge electrodes arranged at a substantially equal pitch in a predetermined axial direction; a high voltage power source for applying, to the discharge electrodes, a voltage equal to or higher than a voltage for starting discharge; a resistor provided between an output electrode of the high voltage power source and the discharge electrodes; a grid electrode provided in the vicinity of the discharge electrodes and between the discharge electrodes and the charge receiving material; and a grid power source for applying a grid voltage to the grid electrode. This charging device reduces a generation amount of ozone, by having an arrangement in which a gap between the discharge electrodes and the grid electrode is set to be equal to or less than 4 mm so as to reduce a discharge current.

According to the technique disclosed in Patent Document 4, a generation amount of ozone can be reduced by reduction in the discharge current. However, because the reduction of ozone generation is not sufficient, approximately 1.0 ppm of ozone is still generated. Further, there is another problem such that the discharge may become unstable due to adherence of the discharge products, the toner, paper powder, or the like to the discharge electrode, or abrasion/deterioration of a tip of the discharge electrode due to discharge energy. Furthermore, a shape of the discharge electrode makes it difficult to clean off the discharge products, the toner, or the paper powder from the discharge electrode.

Moreover, because a gap between the discharge electrode and the charge receiving material is narrow, non-uniformity in charging easily occurs in a longitudinal direction (a direction of the pitch of the discharge electrodes) due to the pitch of a plurality of the discharge electrodes. Here, a shorter pitch of the discharge electrodes may improve the non-uniformity in charging. However, this increases the number of the discharge electrodes, thereby increasing production cost.

In view of the problems of the conventional charging device, for example, Japanese Unexamined Patent Publication No. 249327/2003 (Tokukai 2003-249327) (published on Sep. 5, 2003) (Patent Document 5) discloses a charging device including an ion generating element (a creeping discharge element) which is provided with a discharge electrode having pointed protrusions on a periphery of the discharge electrode and an inductive electrode in a manner such that the discharge electrode and the inductive electrode sandwiches a dielectric body, and generates ions according to application of a high alternating voltage between the discharge electrode and the inductive electrode (hereinafter, this charging system is referred to as a creeping discharge system). The charging device employing this creeping discharge system is small in size, because the charging device does not have a shield case, a grid electrode, and the like. Further, cleaning of the charging device is easy because a discharging surface of the charging device is flat. Therefore, the charging device also has an advantage in easiness of maintenance. Moreover, Japanese Unexamined Patent Publication No. 157447/2004 (Tokukai 2004-157447) (published on Jun. 3, 2004) (Patent Document 6) discloses a charging device that employs a creeping discharge system. The charging device controls a temperature near an ion generator according to environment information concerning a temperature and a humidity so that a stable charging becomes possible.

SUMMARY OF THE INVENTION

However, a condition other than a temperature also influences variation in an amount of ions generated in a charging device that employs a creeping discharge system. Accordingly, a stable discharge characteristic cannot be attained only by performing temperature control as in a technique that is disclosed in Patent Document 6.

The present invention is attained in view of the above problem. The object of the present invention is to provide (i) a charging device capable of stably supplying a necessary amount of ions even under a high-humidity environment condition or after deterioration of each electrode with time, that is, even in a case where discharge is hard to occur, (ii) an image forming apparatus, (iii) a control method of the charging device, and (iv) a computer-readable storage medium recording a control program.

In order to solve the problem above, a charging device of the present invention in which a discharge electrode and an inductive electrode are provided so as to sandwich a dielectric body and be opposed to each other and which charging device charges a charge receiving material by using ions that are extracted by applying an alternating voltage between the discharge electrode and the inductive electrode so as to cause creeping discharge, the charging device includes: a speed acquisition section acquiring a movement speed of the charge receiving material, which movement speed is a speed at which the charge receiving material moves with respect to the charging device; and a voltage control section setting or changing, according to the movement speed of the charge receiving material which speed is acquired by the speed acquisition section, a frequency of an applied voltage that is an alternating voltage to be applied between the discharge electrode and the inductive electrode.

Here, depending on the movement speed of the charge receiving material, an ion current value (an amount of ions supplied per unit time) necessary to supply a predetermined amount of electric charge varies. The amount of ions supplied can be controlled by changing the applied voltage (applied voltage value itself). However, element deterioration easily progresses when the applied voltage is increased. Moreover, when the applied voltage is decreased, discharge itself may become unstable. However, in the charging device of the present invention, the above arrangement makes it possible to set or change a frequency of the applied voltage according to movement speed information of the charge receiving material. Therefore, under the same environment condition or the same use time condition (the same operating period), an amount of ions supplied can be controlled by changing a frequency at the same applied voltage. Therefore, ions can be stably generated. Further, unnecessary deterioration can be suppressed. This contributes to extension of life duration of the charging device. In this way, the charging device of the present invention can always provide a stable supply of a necessary amount of ions.

In order to solve the problem above, a charging device of the present invention in which a discharge electrode and an inductive electrode are provided so as to sandwich a dielectric body and be opposed to each other and which charging device charges a charge receiving material by using ions that are extracted by applying an alternating voltage between the discharge electrode and the inductive electrode so as to cause creeping discharge, the charging device includes: a period acquisition section acquiring operating period information of the charging device; and a voltage control section increasing, according to the operating period information of the charging device which operating period information is acquired by the period acquisition section, (i) a frequency of an applied voltage that is the alternating voltage applied between the discharge electrode and the inductive electrode, in accordance with an increase in the operating period of the charging device, and (ii) a maximum value of an absolute value of the applied voltage in a case where the frequency becomes equal to or more than a predetermined value.

In the arrangement above, according to the operating period information of the charging device, a frequency of the applied voltage is increased in a case where the operating period increases and a maximum value of an absolute value of the applied voltage is increased at the time when this frequency becomes equal to or more than a predetermined value. The operating period information may be, for example, information utilizing an accumulated operating period or an accumulated number of printed sheets of the charging device or an image forming apparatus to which the charging device is attached.

Here, in order to prevent deterioration (life deterioration) due to operation of the device, it is preferable that the amount of ions is increased by increasing the frequency under a condition where discharge is performed stably and, then, after the frequency reaches an upper limit of a setting of the frequency, the amount of ions generated is corrected by increasing the applied voltage. This is because an unnecessary increase of the applied voltage could reduce the life duration of the device. The charging device of the present invention, as in the above arrangement, first increases the frequency, and then increases an applied voltage at the time when stable discharge with the use of a conventional applied voltage becomes impossible due to deterioration. Therefore, the charging device of the present invention is effective in extending life duration of the device. In the way, the charging device of the present invention can always supply a stable amount of ions necessary for charging.

For a fuller understanding of the nature and advantages of the invention, reference should be made to the ensuing detailed description taken in conjunction with the accompanying drawings.

BRIEF DESCRIPTION OF THE DRAWINGS

FIG. 3(*b*) is a front view of the ion generating element that is included in the charging device of the present invention.

DESCRIPTION OF THE EMBODIMENTS

The following specifically explains one embodiment of a charging device of the present invention and an image forming apparatus that includes the charging device, with reference to FIGS. 1 through 9. Note that the following embodiment is one example exemplifying the present invention, and by no means limits a technical scope of the present invention.

Figure 2:
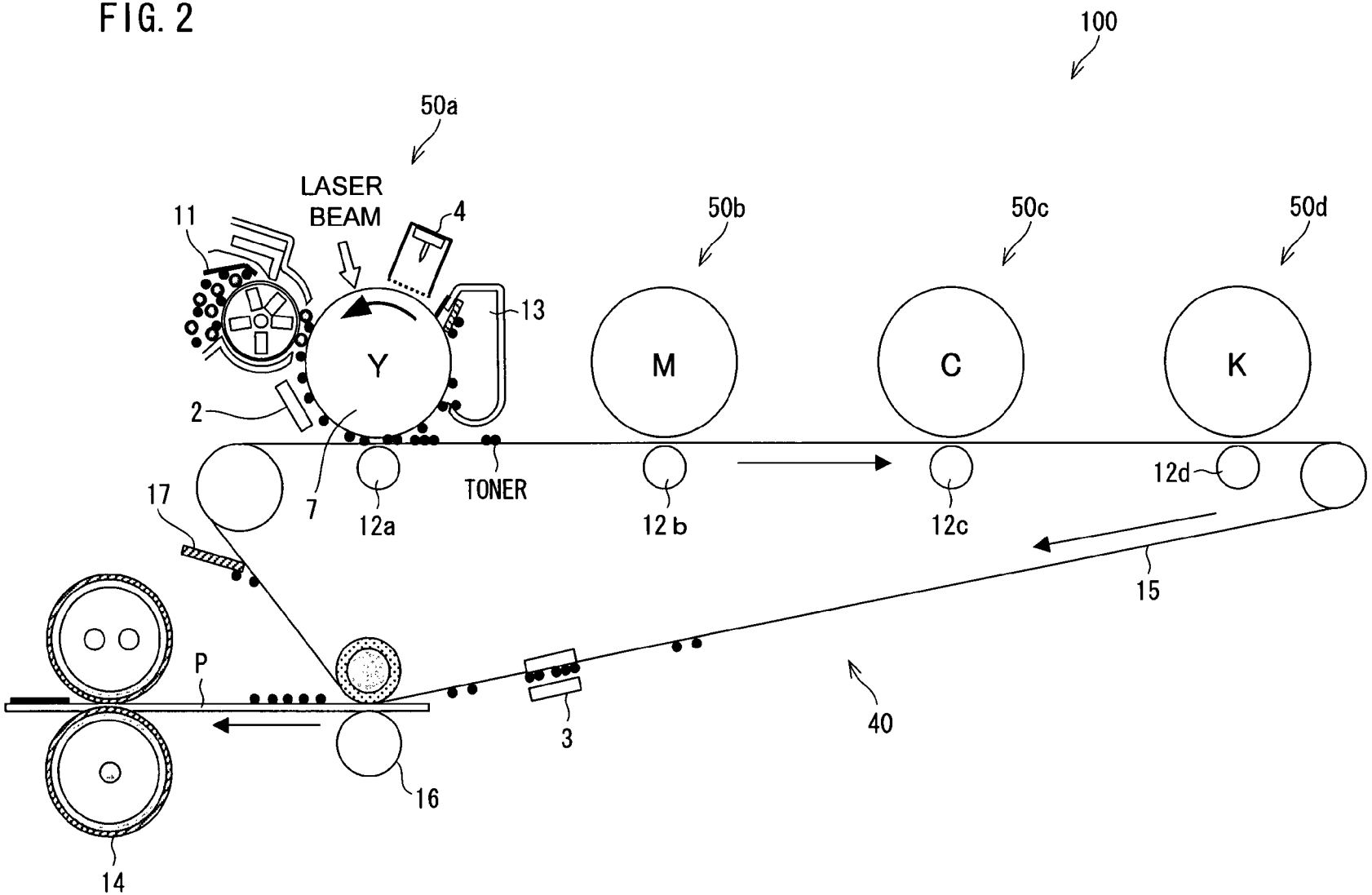
FIG. 2 is an explanatory diagram illustrating a substantial part of an image forming apparatus of the present invention.

First, the following explains a whole arrangement of the image forming apparatus according to the present embodiment. FIG. 2 is a cross sectional view schematically illustrating an arrangement of an image forming apparatus 100 according to the present embodiment. This image forming apparatus 100 is a tandem type printer employing an intermediate transfer system, and can form a full color image.

As illustrated in FIG. 2, the image forming apparatus 100 includes visible image forming units 50*a* to 50*d* for four colors (C, M, Y, and K), a transfer unit 40, and a fixing device 14.

The transfer unit 40 includes an intermediate transfer belt 15 (a bearing member), four first transfer devices 12*a* to 12*d* provided around the intermediate transfer belt 15, a second pre-transfer charging device (charging device for charging before a second transfer) 3, a second transfer device 16, and a transfer cleaning device 17.

Toner images of the colors visualized by the visible image forming units 50*a* to 50*d* are overlapped and transferred to the intermediate transfer belt 15. The intermediate transfer belt 15 further transfers the transferred toner images to recording paper P. Specifically, the intermediate transfer belt 15 is a belt that has no end, and is suspended in a tensioned state by a pair of driving rollers and an idle roller. At the time of forming an image, conveyance driving is subjected to the intermediate transfer belt 15 under control at a predetermined peripheral velocity (in the present embodiment, in a range of 83.5 mm/s to 225 mm/s).

The first transfer devices 12*a* to 12*d* are provided to the visible image forming units 50*a* to 50*d*, respectively. The toner image is transferred to the intermediate transfer belt 15 by applying, to the first transfer devices 12*a* to 12*d*, bias voltage whose polarity is opposite to that of the toner image formed on a surface of a photosensitive drum (an electrostatic latent image bearing member) 7. Each of the first transfer devices 12*a* to 12*d* is positioned so as to face a corresponding one of the visible image forming units 50*a* to 50*d* via the intermediate transfer belt 15.

The second pre-transfer charging device 3 re-charges the toner image that has been overlapped and transferred to the intermediate transfer belt 15. In the present embodiment, the second pre-transfer charging device 3 discharges ions so as to charge the toner image, which is explained later in detail.

The second transfer device 16 re-transfers, to the recording paper P, the toner image which has been transferred to the intermediate transfer belt 15. The second transfer device 16 is provided in contact with the intermediate transfer belt 15. The transfer cleaning device 17 cleans a surface of the intermediate transfer belt 15 after the toner image is re-transferred.

Around the intermediate transfer belt 15 of the transfer unit 40, the first transfer units 12*a* to 12*d*, the second pre-transfer charging device 3, the second transfer device 16, and the transfer cleaning device 17 are provided in this order from an upstream side in a carrying direction of the intermediate transfer belt 15.

The fixing device 14 is provided in a downstream side of the second transfer device 16 in a carrying direction of the recording paper P. The fixing device 14 fixes, to the recording paper P, the toner image which has been transferred onto the recording paper P by the second transfer device 16.

Further, the four visible image forming units 50*a* to 50*d* are provided in contact with the intermediate transfer belt 15 along the carrying direction of the intermediate transfer belt 15. The four visible image forming units 50*a* to 50*d* have the same arrangement except that different toner colors are used. The toner colors of the four visible image forming units 50*a* to 50*d* are yellow (y), magenta (M), cyan (C), and black (K), respectively. The following description deals with only the visible image forming unit 50*a*, and explanations of the other visible image forming units 50*b* to 50*d* are omitted. Accordingly, FIG. 2 illustrates only members of the visible image forming unit 50*a* However, the other visible image forming units 50*b* to 50*d* also include the same members as the visible image forming unit 50*a*.

The visible image forming unit 50*a* includes the photosensitive drum 7, a latent image charging device 4 that is provided in the vicinity of the photosensitive drum 7, a laser writing unit (not illustrated), a developing device 11, a first pre-transfer charging device (charging device for charging before a first transfer) 2, a cleaning device 13, and the like.

The latent image charging device 4 charges a surface of the photosensitive drum 7 to a predetermined electric potential. In the present embodiment, the latent image charging device 4 emits ions so as to charge the photosensitive drum 7. A detailed explanation of the latent image charging device 4 is given later.

According to image data received from an external device, the laser writing unit (i) irradiates a laser beam on the photosensitive drum 7 (exposes the photosensitive drum to the laser beam), and (ii) writes, by scanning a light image, an electrostatic latent image on the photosensitive drum 7 that has been uniformly charged.

The developing device 11 provides toner to the electrostatic latent image that is formed on the surface of the photosensitive drum 7, so as to form the toner image by developing the electrostatic latent image.

The first pre-transfer charging device 2 re-charges the toner image that is formed on the surface of the photosensitive drum 7, before the toner image is transferred. In the present embodiment, the first pre-transfer charging device 2 emits ions so as to charge the toner image. A detailed explanation of the first pre-transfer charging device 2 is given later.

The cleaning device 13 removes and collects residual toner that is left on the photosensitive drum 7, after the toner image is transferred to the intermediate transfer belt 15. This allows forming a new electrostatic latent image and a new toner image on the photosensitive drum 7.

Around the photosensitive drum 7 of the visible image forming unit 50*a*, the latent image charging device 4, the laser writing unit, the developing device 11, the first pre-transfer charging device 2, the first transfer device 12*a*, and the cleaning device 13 are provided in this order from an upstream side in a rotation direction of the photosensitive drum 7.

Next, the following explains an image forming operation of the image forming apparatus 100. An operation of the visible image forming unit is explained with reference to members (members having reference numerals) of the visible image forming unit 50*a*. However, the visible image forming units 50*b* to 50*d* operate in the same manner as the visible image forming unit 50*a*.

First, the visible image forming apparatus 100 acquires image data from an external device (not illustrated). Moreover, a driving unit (not illustrated) of the image forming apparatus 100 rotates the photosensitive drum 7 in a direction shown by an arrow illustrated in FIG. 2 at a predetermined velocity (in the present embodiment, in a range of 83.5 mm/s to 225 mm/s). Simultaneously, the latent image charging device 4 charges the surface of the photosensitive drum 7 to a predetermined electric potential.

Next, according to the acquired image data, the laser writing unit exposes the surface of the photosensitive drum 7, and writes, to the surface of the photosensitive drum 7, an electrostatic latent image corresponding to the image data. Then, the developing device 11 provides toner to the electrostatic latent image that is formed on the surface of the photosensitive drum 7. As a result, the toner adheres to the electrostatic latent image and a toner image is formed.

The first pre-transfer charging device 2 re-charges this toner image that is formed on the surface of the photosensitive drum 7. Then, bias voltage, whose polarity is opposite to that of the toner image formed on the surface of the photosensitive drum 7, is applied to the first transfer device 12*a*. This transfers (a first transfer), to the intermediate transfer belt 15, the toner image that is re-charged by the first pre-transfer charging device 2.

The visible image forming units 50*a* to 50*d* perform the aforementioned operation in turn so that the toner images of four colors Y, M, C, and K are overlapped on the intermediate transfer belt 15 in turn.

The overlapped toner images are carried to the second pre-transfer charging device 3 by the intermediate transfer belt 15. Then, the second pre-transfer charging device 3 re-charges thus carried toner images. Subsequently, the intermediate transfer belt 15 that bears the re-charged toner images is pressed against the recording paper P, which is fed from a paper feeding unit (not illustrated), by the second transfer device 16. Moreover, voltage whose polarity is opposite to that of toner charge is applied to the intermediate transfer belt 15. As a result, the toner images are transferred to the recording paper P (a second transfer).

Then, the fixing device 14 fixes the toner images to the recording paper P. The recording paper P on which the image has been recorded is ejected to a paper output unit (not illustrated). After the transfer described above, residual toner left on the photosensitive drum 7 is removed and collected by the cleaning device 13. Further, residual toner left on the intermediate transfer belt 15 is removed and collected by the transfer cleaning device 17.

A printing speed (a movement speed of a charge receiving material) is set by an image formation controlling section 42 according to a user input with the use of an operation panel of the image forming apparatus 100 or a type of recording paper P that is used. Moreover, an accumulated operating period and an accumulated number of sheets printed are measured by the image formation controlling section 42. Further, a temperature/humidity sensor 41 detects a temperature and a humidity of the environment in which image processing is performed.

The above operation allows the image forming apparatus 100 to perform an appropriate printing on recording paper P.

Next, an arrangement of the pre-transfer charging device is explained in detail. The aforementioned first pre-transfer charging device 2, latent image charging device 4, and second pre-transfer charging device 3 are the same other than that the first pre-transfer charging device 2, latent image charging device 4, and second pre-transfer charging device 3 are provided in different positions, respectively. In the latent image charging device 4, a grid electrode for controlling an electric potential of charging may be provided between an ion generating element (a creeping discharge element) 1 explained below and the photosensitive drum 7. A position of this grid electrode is preferably approximately 1 mm away from the photosensitive drum 7, and approximately 2 mm to 10 mm away from the ion generating element 1. The following explains the second pre-transfer charging device 3 in detail, but detailed explanations of the first pre-transfer charging device 2 and the latent image charging device 4 are omitted.

Figure 1:
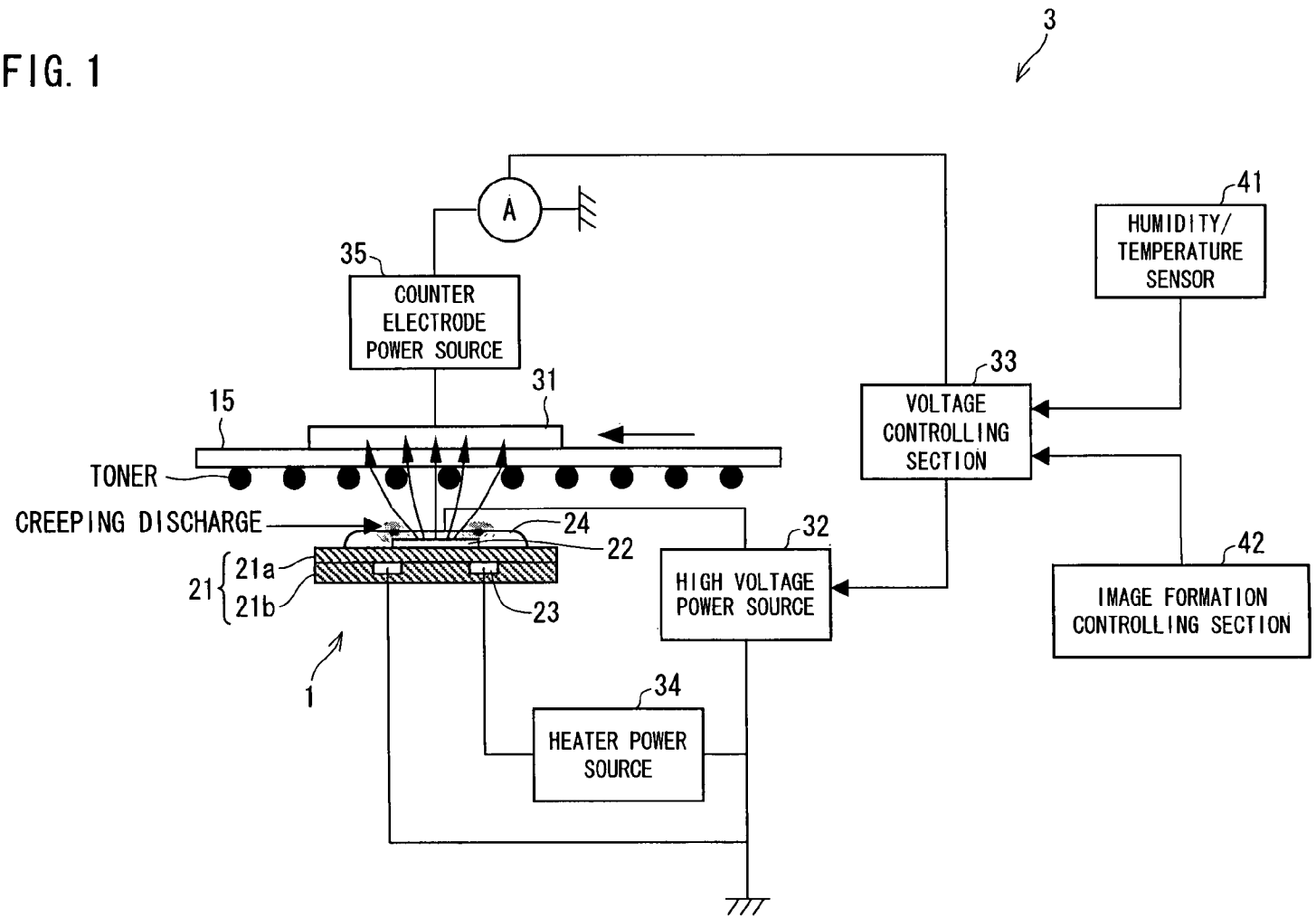
FIG. 1 is a diagram illustrating an arrangement according to one embodiment of a charging device of the present invention.
Figure 3A:
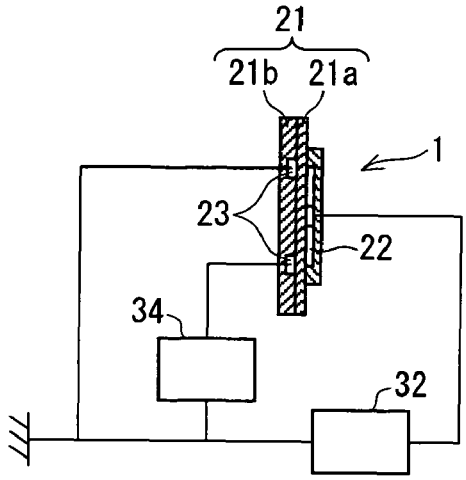
FIG. 3(*a*) is a side view of an ion generating element that is included in the charging device of the present invention.
Figure 3B:
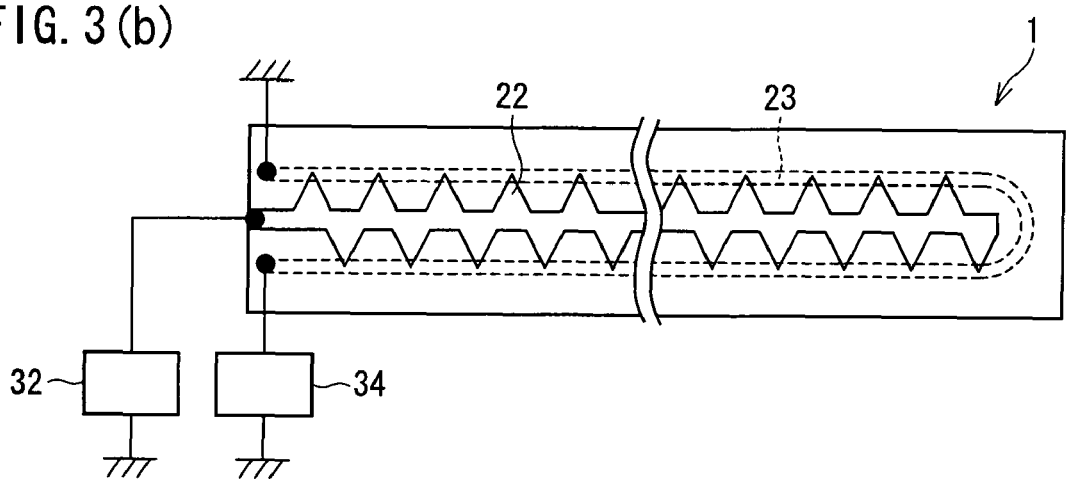

FIG. 1 is a whole system chart of the second pre-transfer charging device 3 that is provided in the vicinity of the intermediate transfer belt 15. FIG. 3(*a*) is a side view of the ion generating element 1 that is included in the second pre-transfer charging device 3, and FIG. 3(*b*) is a front view of an ion generating element 1 that is included in the second pre-transfer charging device 3.

As illustrated in FIG. 1, the second pre-transfer charging device 3 includes the ion generating element 1, a counter electrode 31, a high voltage power source 32, and a voltage controlling section (voltage control section) 33.

The ion generating element 1 includes a dielectric body 21, a discharge electrode 22, an inductive electrode 23, and a coating layer (protective layer) 24. The ion generating element 1 generates ions by discharge that is generated due to an electric potential difference between the discharge electrode 22 and the inductive electrode 23 (corona discharge that is produced in the vicinity of the discharge electrode 22 in a direction along a surface of the dielectric body 21).

The dielectric body 21 is arranged as a flat plate that is made by bonding an upper dielectric body 21*a* and a lower dielectric body 21*b* that are substantially rectangular. When the dielectric body 21 is made of an organic material, a preferable material of the dielectric body 21 is a material that is excellent in oxidation resistance. For example, resin such as polyimide or glass epoxy may be used as such a material. When an inorganic material is selected as a material of the dielectric body 21, a mica laminate material, alumina, glass-ceramics, forsterite, and ceramic such as steatite may be used as the material. In terms of corrosion resistance, an inorganic material is more preferable as the material of the dielectric body 21. Further, in terms of formability, easiness in electrode formation later explained, low moisture resistance, or the like, ceramic is preferably used in formation of the dielectric body 21. Moreover, it is desirable that an insulation resistance between the discharge electrode 22 and the inductive electrode 23 is uniform. Accordingly, the less the density inside the material of the dielectric body 21 varies and the more uniform an insulation ratio of the dielectric body 21 becomes, the more preferable the dielectric body 21 becomes. A preferable thickness of the dielectric body 21 is 50 μm to 250 μm. However, the thickness is not limited to this value.

The discharge electrode 22 is formed integrally with the dielectric body 21 on a surface of the dielectric body 21 (the upper dielectric body 21*a*). A material of the discharge electrode 22 is not specifically limited as long as the material is electrically conductive like, for example, tungsten, silver, or stainless steel. However, the material must not cause deformation such as meltdown or scattering due to discharge. It is preferable that the discharge electrode 22 has a uniform depth from a surface of the dielectric body 21 (in a case where the discharge electrode 22 is provided toward the inductive electrode 23 from the surface of the dielectric body 21) or a uniform thickness from the surface of the dielectric body 21 (in a case where the discharge electrode 22 is provided so as to protrude from the surface of the dielectric body 21). In the present embodiment, tungsten or stainless steel is used as the material of the discharge electrode 22.

A shape of the discharge electrode 22 may be any shape as long as the shape extends evenly in a direction orthogonal with respect to a direction in which the intermediate transfer belt 15 moves. However, it is more preferable to have a shape that easily causes electric field concentration between the discharge electrode 22 and the inductive electrode 23, if possible. This is because such a shape allows discharge between the discharge electrode 22 and the inductive electrode 23 to be produced even in a case where a low voltage is applied between the discharge electrode 22 and the inductive electrode 23. In the present embodiment, the shape of the discharge electrode 22 has a comb-tooth shape as illustrated in FIG. 3(*b*) so that discharge is easily produced.

The inductive electrode 23 that is formed inside the dielectric body 21 (between the upper dielectric body 21*a* and the lower dielectric body 21*b*) and provided so as to be opposed to the discharge electrode 22. This is because it is preferable that the insulation resistance between the discharge electrode 22 and the inductive electrode 23 are uniform and the discharge electrode 22 and the inductive electrode 23 are provided in parallel with each other. This arrangement makes it possible to have a constant distance between the discharge electrode 22 and the inductive electrode 23 (hereinafter, referred to as a distance between electrodes). Accordingly, a discharge state between the discharge electrode 22 and the inductive electrode 23 becomes stable and ions can be preferably generated. In this arrangement, the discharge electrode 22 and the inductive electrode 23 are provided to sandwich the upper dielectric body 21*a* and to be opposed to each other. Note that there is no problem in providing the dielectric body 21 as one layer and the inductive electrode 23 on a back surface of the dielectric body 21. However, this case requires ensuring a creeping distance sufficient with respect to an applied voltage or coating the discharge electrode 22 and the inductive electrode 23 by using insulating coating layers (protective layers), for preventing the discharge electrode 22 and the inductive electrode 23 from leaking.

In the same manner as the discharge electrode 22, a material of the inductive electrode 23 is not specifically limited as long as the material is electrically conductive like, for example, tungsten, silver, or stainless steel. The present embodiment employs tungsten or stainless steel as the material of the inductive electrode 23. One end of the inductive electrode 23 is connected to a heater power source 34 and the other end is connected to ground. A shape of the inductive electrode 23 is explained later. The heater power source 34 applies a predetermined voltage (here, 12V) to the inductive electrode 23 so that the inductive electrode 23 generates heat due to Joule heat. By causing the inductive electrode 23 to generate heat, a temperature of the dielectric body 21 rises (to approximately 60° C. in the present embodiment). This can suppress moisture absorption of the dielectric body 21 and makes it possible to stably generate ions in a high humidity environment. When the dielectric body 21 is made of ceramic, the dielectric body 21 itself does not absorb moisture. However, when dew condensation occurs on a surface of the dielectric body 21, a discharge characteristic deteriorates. Therefore, it is effective to prevent dew condensation or vanish dewdrops by causing the heater to generate heat.

It is preferable that the discharge electrode 22 and the inductive electrode 23 are plated with copper, gold, nickel or the like. The plating extends life duration as an electrode and also increases strength of the electrode.

The coating layer 24 is formed on the dielectric body 21 so as to cover the discharge electrode 22, by using, for example, alumina (aluminum oxide), glass, silicon, or the like.

A fabrication method of the ion generating element 1 is explained here. However, the fabrication method is not limited to the following method or numeral values. First, an alumina sheet having a thickness of 0.2 mm is cut to a predetermined size (for example, 8.5 mm in width×320 mm in length) and two alumina bases that have a substantially the same size are formed. These alumina bases are used as the upper dielectric body 21*a* and the lower dielectric body 21*b*. Next, on an upper surface of the upper dielectric body 21*a*, tungsten is screen-printed in a comb-tooth shape as the discharge electrode 22 so that the discharge electrode 22 is integrally formed with the upper dielectric body 21*a*. Meanwhile, on an upper surface of the lower electrode 21*b*, tungsten is screen-printed in a shape of the letter U so that the dielectric electrode 23 is integrally formed with the lower dielectric body 21*b*. Then, on the surface of the upper dielectric body 21*a*, the coating layer 24 that is made of alumina is formed so as to cover the discharge electrode 22. This forms insulation coating of the discharge electrode 22. After a lower surface of the upper dielectric body 21*a* and an upper surface of the lower dielectric body 21*b* are brought together so that the discharge electrode 22 and the inductive electrode 23 are opposed to each other via the upper dielectric body 21*a*, crimping is carried out. Then, the upper dielectric body 21*a* and the lower dielectric body 21*b* are put into a furnace and baked in a non-oxidized atmosphere at a temperature in a range of 1400° C. to 1600° C. The ion generating element 1 of the present embodiment can be easily fabricated in this way. Crimping of unbaked sheets may be before printing of the discharge electrode 22 or before/after formation of the coating layer 24. Moreover, the number of crimping may be determined as appropriate.

The counter electrode 31 of the present embodiment is a stainless steel plate. The counter electrode 31 is provided in a position that is opposed to the ion generating element 1 via the intermediate transfer belt 15 so that the counter electrode 31 touches to a back surface (surface on a side where a toner image is not formed) of the intermediate transfer belt 15. The counter electrode 31 is connected to ground via the counter electrode power source 35.

The counter electrode power source 35 is arranged to apply a predetermined voltage to the counter electrode 31. Here, the counter electrode power source 35 is provided with an ampere meter for the purpose of checking out whether a discharge current necessary for charging is supplied. Specifically, a resistor that has approximately 1 kΩ to 100 kΩ is provided between the counter electrode 31 and a ground potential, and a current amount is measured by detecting a voltage between the counter electrode 31 and the ground potential. However, this circuit may be omitted in a case where how a discharge characteristic of the ion generating element 1 changes depending on a change in an operating condition is known.

The counter electrode power source 35 as explained above is provided so as to make discharge form the discharge electrode 22 easy to occur. By varying an electric potential of the counter electrode 31, the counter electrode power source 35 can vary an extraction amount of ions that is generated in the vicinity of the ion generating element 1. However, the counter electrode power source 35 is not necessarily required, but is dispensable.

Figure 4:
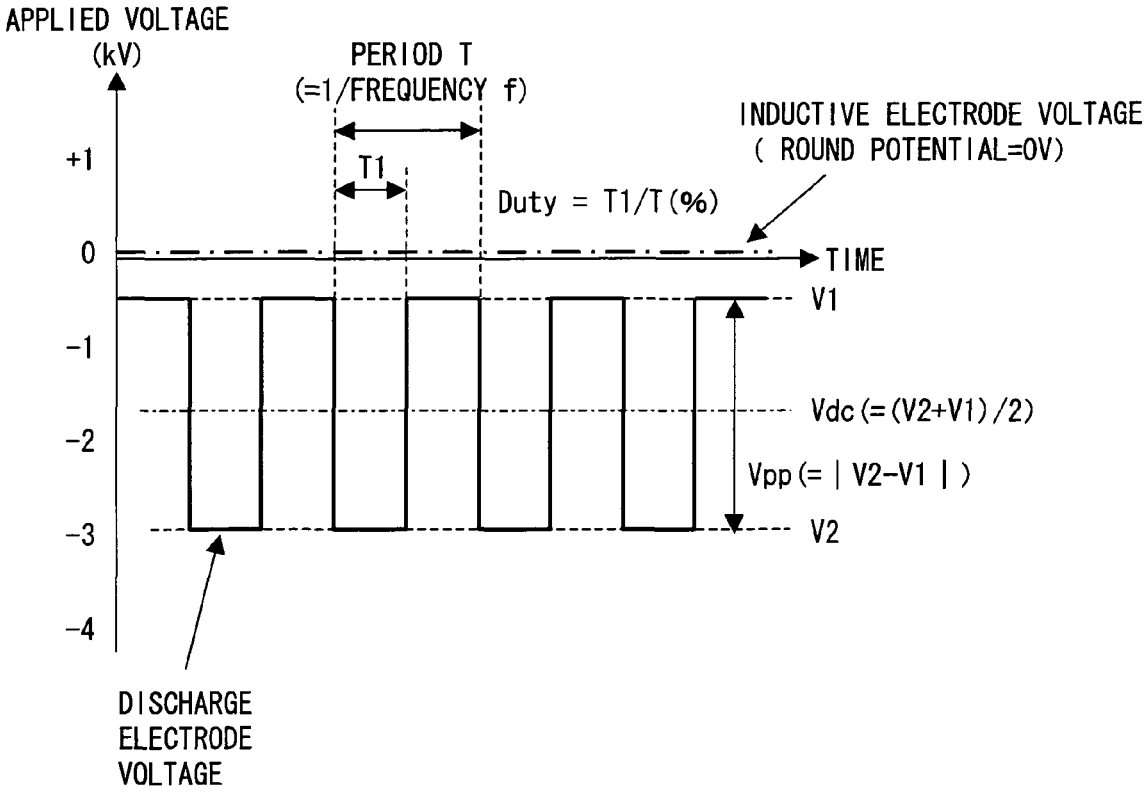
FIG. 4 is a diagram illustrating one example of an applied voltage.

The high voltage power source (voltage application circuit) 32 supplies a voltage, as shown in FIG. 4, between the discharge electrode 22 and the inductive electrode 23 of the ion generating element 1, under control of the voltage controlling section 33. The high voltage power source 32 employs a pulse wave of an applied voltage Vpp of 2 kV to 4 kV, an offset bias Vdc of −1 kV to −2 kV, and a frequency f of 500 Hz to 2 kHz. A high-voltage-side-time duty of the pulse wave is arranged to be 10% to 50%. By setting Vpp and Vdc as appropriate, a maximum voltage V2 can be appropriately set. Accordingly, the voltage control section 33 can set a setting of the high voltage power source 32 according to a characteristic of the ion generating element 1 and an operation condition, so that a stable discharge becomes possible. A waveform of the applied voltage may be a sine wave. However, a pulse wave is more preferable, in consideration of discharge efficiency and particularly discharge performance under a high humidity condition.

When an alternating high voltage is applied between the discharge electrode 22 and the inductive electrode 23 by operating the high voltage power source 32 in the above arrangement, a creeping discharge (corona discharge) occurs in the vicinity of the discharge electrode 22 due to an electric potential difference between the discharge electrode 22 and the inductive electrode 23. This ionizes an atmosphere surrounding the discharge electrode 22 and generates negative ions. Consequently, a toner image on the intermediate transfer belt 15 is charged to a predetermined charging amount (here approximately −30 μC/g).

Moreover, the high voltage power source 32 is connected to the voltage controlling section 33. The voltage controlling section (voltage control section) 33 controls a size and a frequency of the voltage applied by the high voltage power source 32. Specifically, the voltage controlling section 33 refers to a state (a movement speed of a charge receiving material, operating period of the charging device) at the time of forming an image which state is acquired by the image formation controlling section (speed acquisition section, period acquisition section) 42, and controls a frequency or an amplitude (hereinafter, Vpp) of the alternating voltage, or a DC offset bias (hereinafter, Vdc). Alternatively, the voltage controlling section 33 refers to values of a temperature and a humidity that are detected by the temperature/humidity sensor (state information acquisition section) 41, and controls the frequency, Vpp, and/or Vdc of the alternating voltage. In other words, the voltage controlling section 33 sets or changes a condition of the alternating voltage according to state information indicative of a state in which a charging device (here, second pre-transfer charging device 3) is used. The voltage controlling section 33 includes, for example, a table in which the state information corresponds to a condition (size, frequency) of the alternating voltage (applied voltage). With reference to the table, the voltage controlling section 33 may set or change a condition of the alternating voltage.

A control signal from the voltage controlling section 33 is sent to the high voltage power source 32 and an alternating voltage is applied to the ion generating element 1. In this way, a condition of a voltage applied by the high voltage power source 32 is controlled according to a state (a state at the time of forming an image) in which the second pre-transfer charging device 3 is used. As a result, it becomes possible to always supply a toner image with an appropriate amount of ions, regardless of a change in an environment condition of the ion generating element 1, a change of the ion generating element 1 with time, or a change in a printing speed of the image forming apparatus 100.

In the present embodiment, as illustrated in FIG. 1, the second pre-transfer charging device 3 includes, as a state information acquisition section of the image formation controlling section 42 which state information acquisition section acquires state information indicative of a state in which the second pre-transfer charging device 3 is used, (i) a setting section setting a printing speed, (ii) a measuring section measuring an accumulated operating time or an accumulated number of sheets printed, and (iii) the humidity/temperature sensor 41. Moreover, the voltage controlling section 33 may be included in the image formation controlling section 42.

The following specifically explains a control performed by the voltage controlling section 33 according to a state in which the charging device (here, the second pre-transfer charging device 3) is used.

(Case in which Environment at the Time of Printing Changes)

Figure 5:
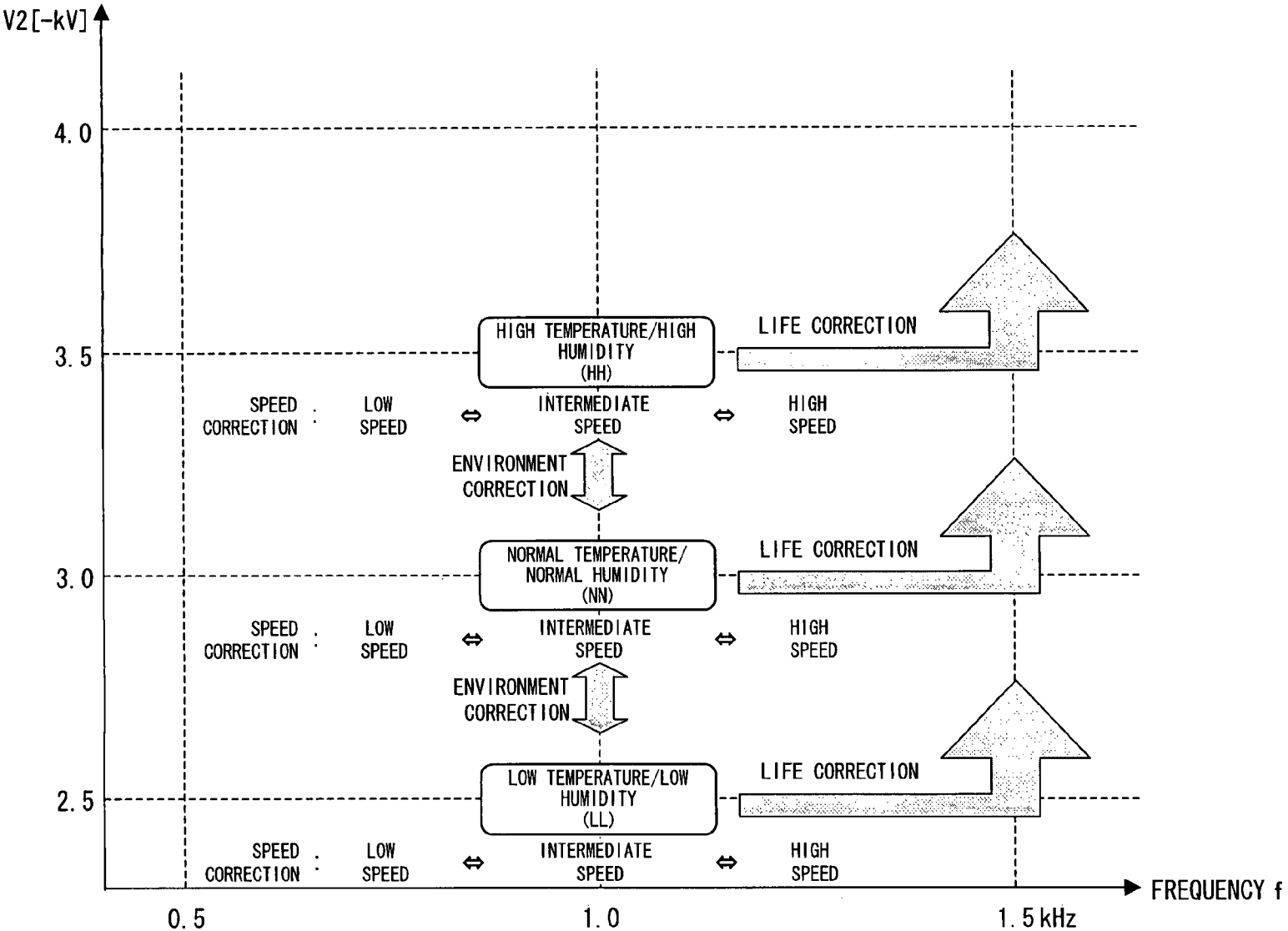
FIG. 5 is an explanatory diagram illustrating how a condition of an applied voltage is changed in a case where an environment condition changes at the time of printing.
Figure 6:
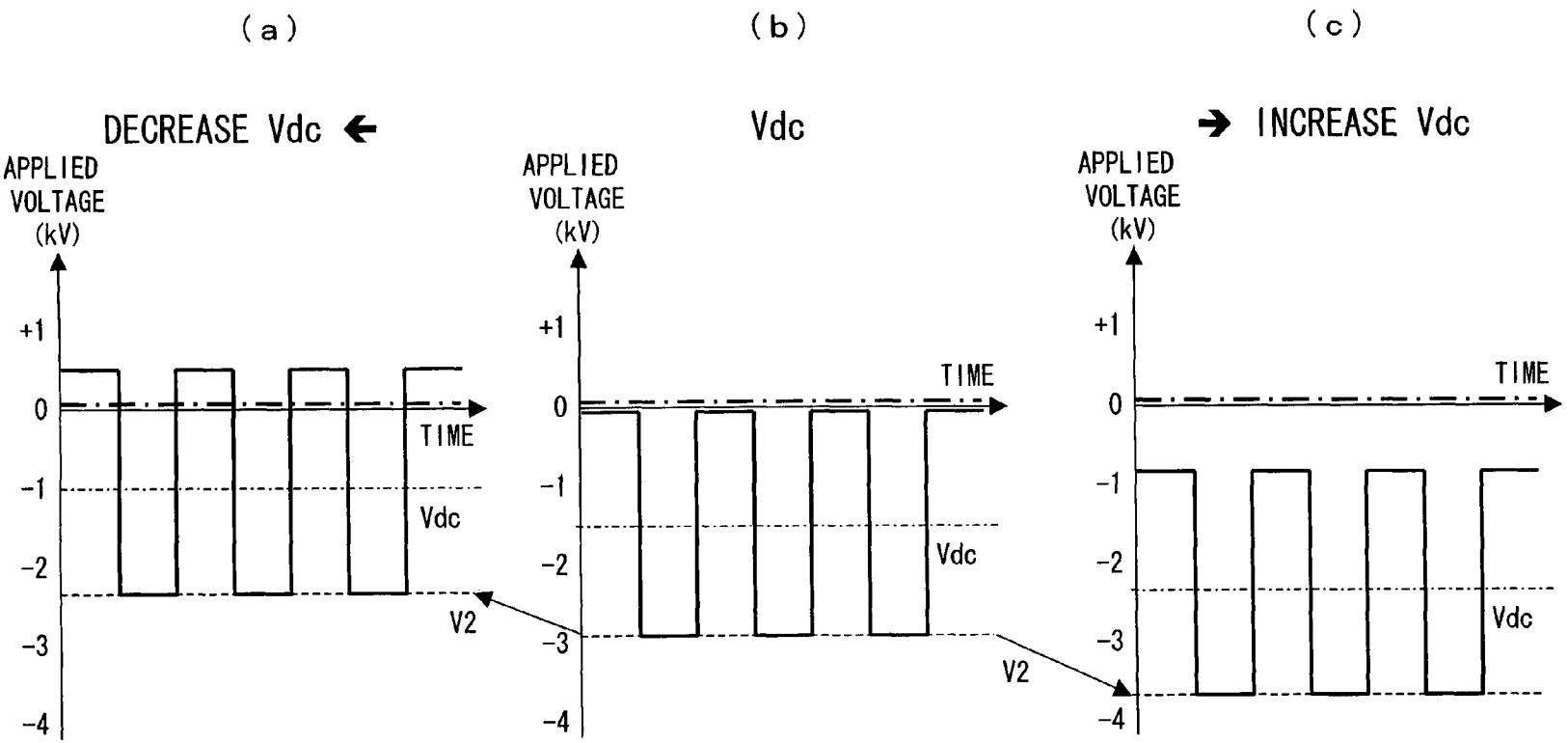
FIG. 6 is a diagram illustrating an applied voltage at the time when an absolute value of a DC offset bias is changed.

With reference to FIGS. 5 through 8, a case where an environment condition (temperature and humidity) at the time of printing changes is explained. FIG. 5 is an explanatory diagram that explains a method (control method) of changing a condition of an applied voltage.

Here, a change in a case where an environment condition at the time of printing changes is explained. Under a high-pressure/high-humidity environment (HH environment), an amount of water on a surface of the ion generating element 1 is large and a creeping resistance tends to become lower. Therefore, even when a voltage is applied, an electric potential difference between the discharge electrode 22 and the inductive body 21 does not become sufficiently large due to influence of a time constant which influence is caused by the water on the surface. Accordingly, discharge may become unstable. As explained above, removal of water by operating the heater is effective to a certain extent. However, the effect is not sufficient in consideration of discharge uniformity or the like. In order to solve this problem, an absolute value of the maximum voltage V2 is increased, by increasing an absolute value of a DC offset bias Vdc, as illustrated in (c) of FIG. 6, from Vdc of a standard environment state at a room temperature and a room humidity which standard environment state is illustrated in (b) of FIG. 6. This can increase an electric potential difference from an electric potential of the dielectric body 21 (an electric potential of the inductive electrode 23) and stabilize discharge.

On the contrary to the case of the HH environment, discharge easily occurs in a low-temperature/low-humidity environment (LL environment). Accordingly, when an applied voltage is unnecessarily increased, there is possibility of promoting ozone generation or increasing damage to the ion generating element 1. In order to solve this problem, the absolute value of Vdc is decreased, as illustrated in (a) of FIG. 6, so as to decrease the absolute value of V2. It is preferable to have a setting that allows obtaining a necessary amount of ions by having the absolute value of V2 decreased as mentioned above. Note that, in the HH environment, a negative effect of increase in the applied voltage does not become a problem in practice, because an electrical damage to the ion generating element 1 is small. This is because the ozone generation is hard to occur and a substantial electric potential difference between the discharge electrode 22 and the dielectric body 21 becomes rather small. In the HH environment, a variable Vdc is effective in allowing a circuit configuration to be relatively simple and produced at a low cost.

Figure 7:
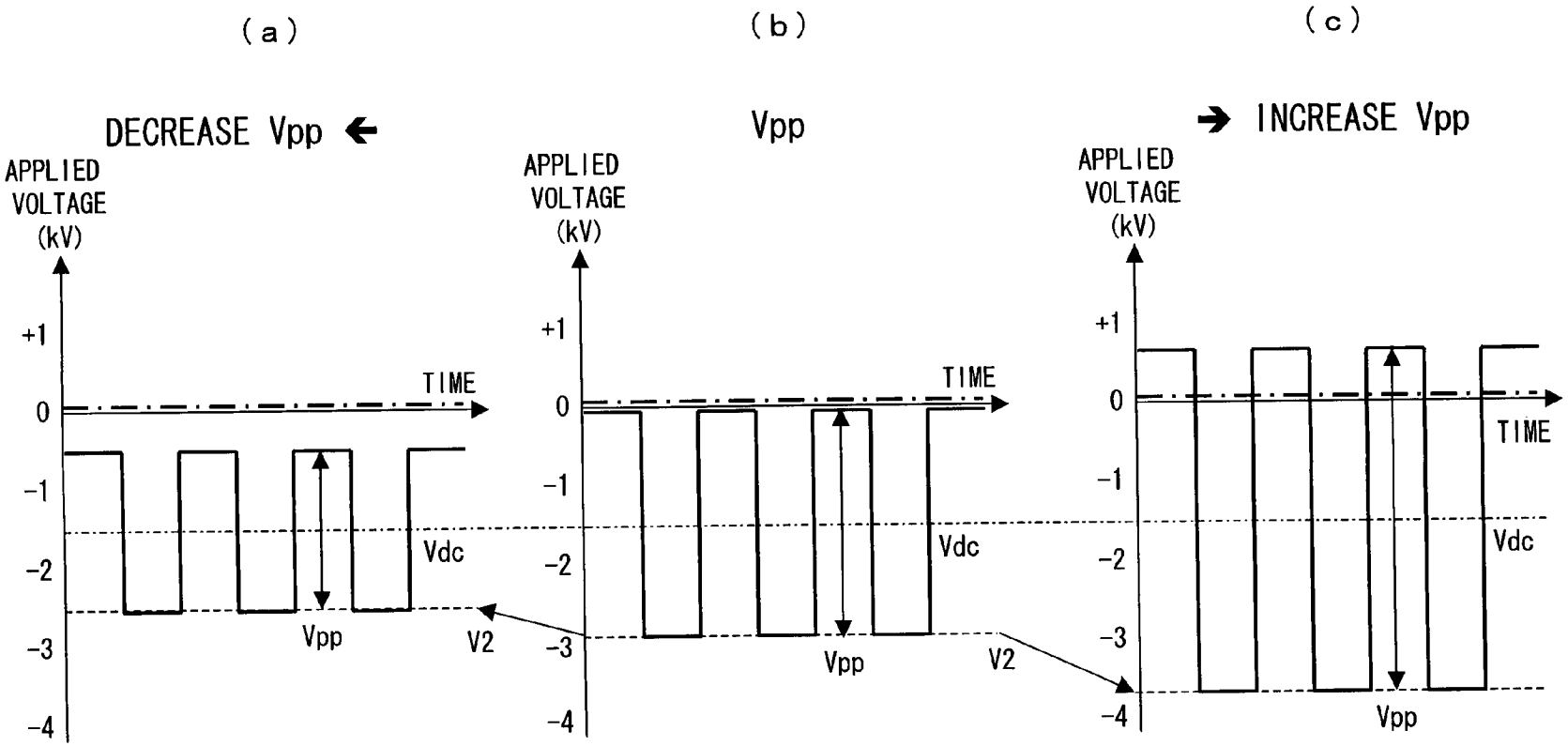
FIG. 7 is a diagram illustrating an applied voltage at the time when an alternating voltage amplitude is changed.

Moreover, as another method of changing a condition of the applied voltage other than changing Vdc as mentioned above, an alternating voltage amplitude Vpp may be changed as illustrated in FIG. 7. In this case, substantially the same effect as in a case where Vdc is changed is attained by (i) setting, in the HH environment, a Vpp that is increased as illustrated in (c) of FIG. 7 from a Vpp in a standard environment state at a normal temperature and a normal humidity which standard environment state is illustrated in (b) of FIG. 7 and (ii) setting, in the LL environment, a Vpp that is decreased as illustrated in (a) of FIG. 7 from the Vpp in the standard environment state. An advantage of changing Vpp is that an amount of ions generated can be more effectively increased. This is because (i) discharge from the discharge electrode 22 to the dielectric body 21 due to an increase in V2 and (ii) discharge in a reverse way thereof, that is, discharge in which an electric charge that gets on the dielectric body 21 due to the above discharge moves so as to return toward the discharge electrode 22 actively occur.

Figure 8:
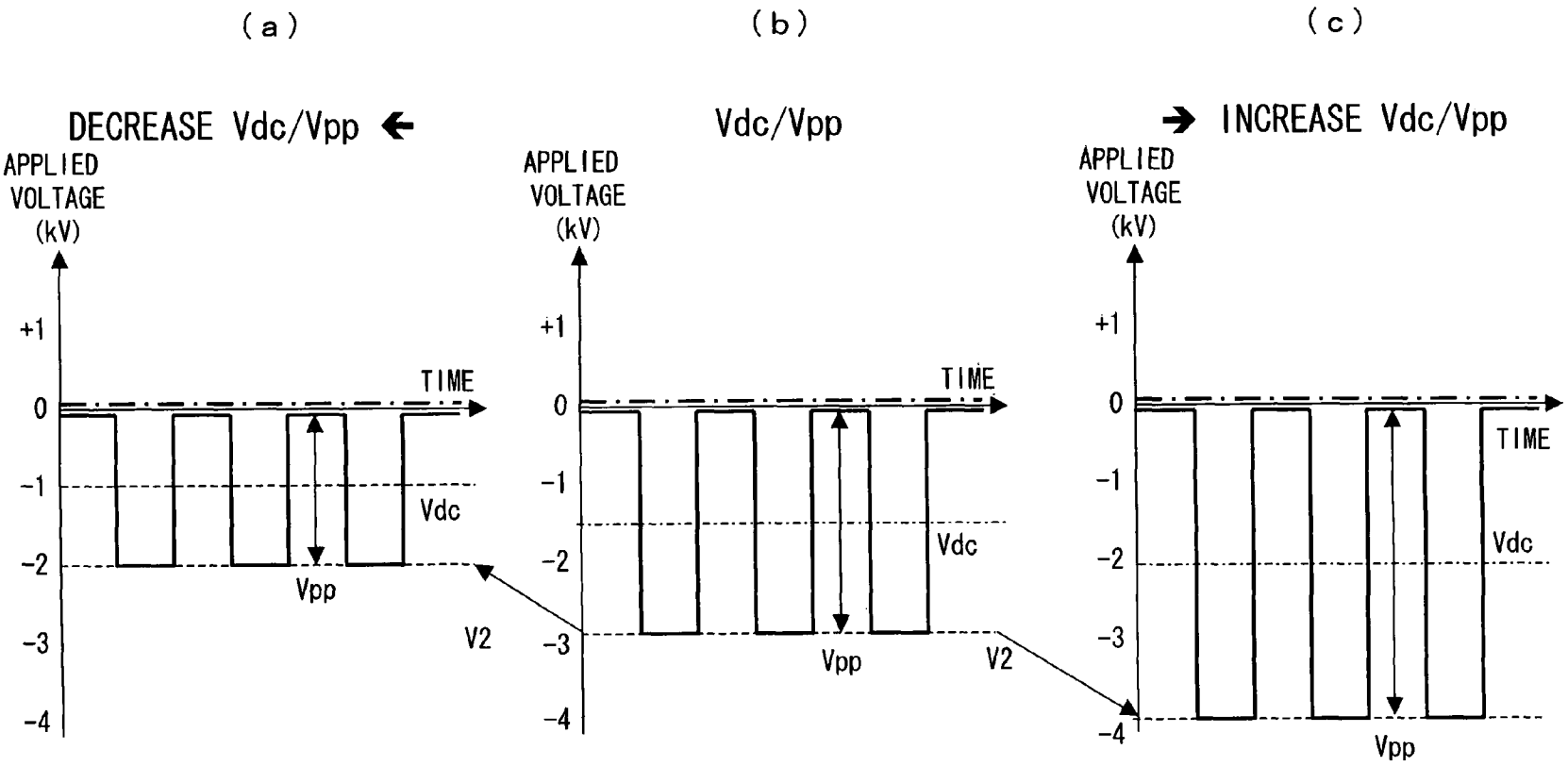
FIG. 8 is a diagram illustrating an applied voltage at the time when an absolute value of a DC offset bias and an alternating voltage amplitude are changed in combination.

As still another method of changing the condition of the applied voltage, as illustrated in FIG. 8, the method of changing Vdc and the method of changing Vpp may be combined. This method is advantageous because this case is capable of not only changing a generation amount itself of ions but also controlling an amount of generated ions that is lead to the counter electrode. Such control is possible because Vdc that is a center electric potential is changed and, accordingly, a bias electric field between the ion generating element 1 and the counter electrode 31 can be appropriately set.

(Case where Movement Speed of Charge Receiving Material Changes)

Figure 9:
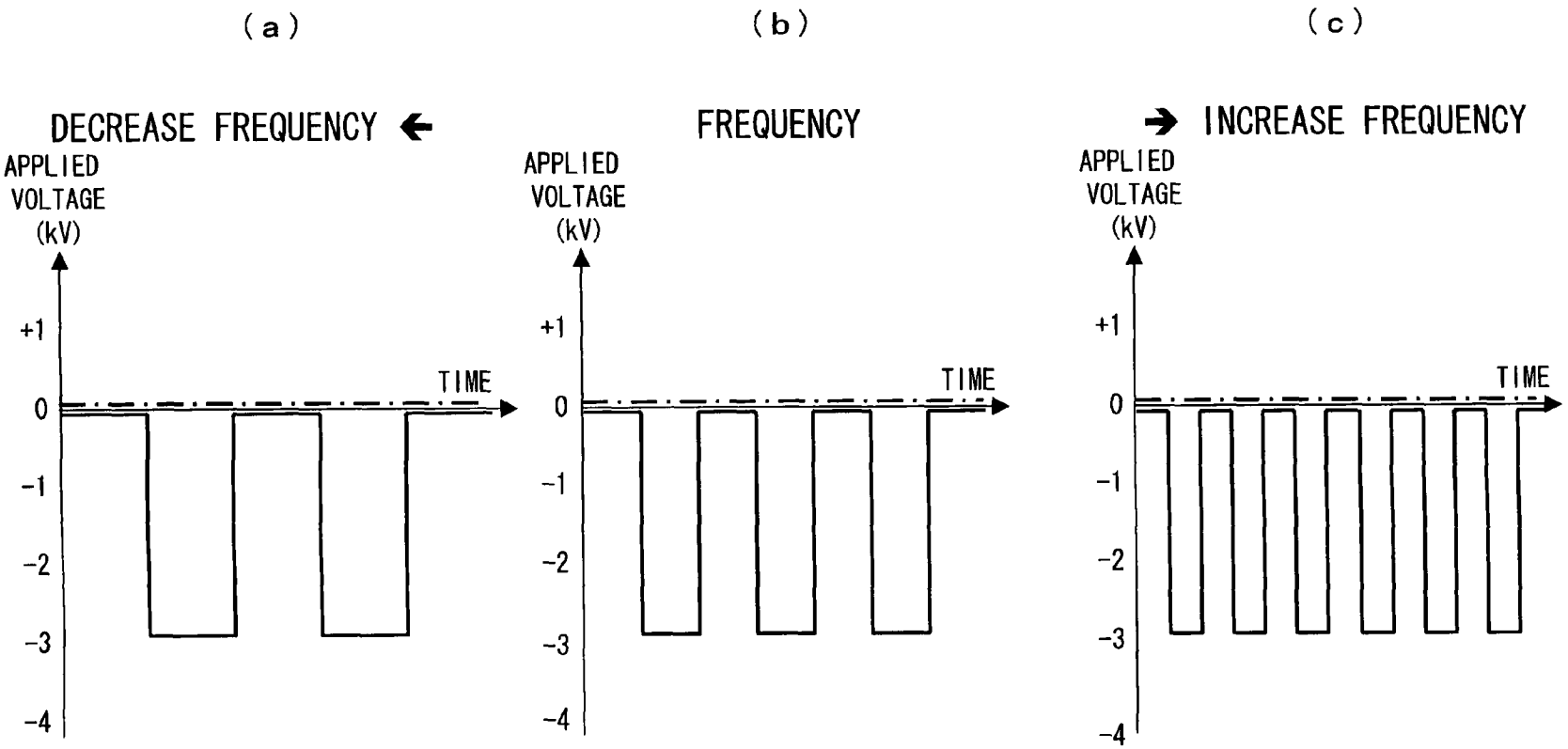
FIG. 9 is a diagram illustrating an applied voltage at the time when a frequency is changed.

Regarding control performed by the voltage controlling section 33, the following explains a case where a printing speed, that is, a movement speed of a charge receiving material (here, a toner image) among printing conditions changes. With respect to a certain environment condition or a certain use history of the charging device, a condition that stabilizes discharge substantially depends on an applied voltage value. Here, in case where a movement speed of the charge receiving material is different, it is necessary to change an amount of ions that are supplied per unit time. However, increase of the applied voltage value itself could promote deterioration of the element, while decrease of the applied voltage value could destabilize discharge. Therefore, it is preferable that a frequency of the applied voltage itself is not changed but a frequency of the applied voltage is changed for changing the amount of ions that are supplied per unit time. FIG. 9 illustrates one example of a case where the frequency is changed. (b) of FIG. 9 is a frequency in a case where the printing speed is at a medium level (for example, 167 mm/s). Under a condition where the printing speed is high (for example, 225 mm/s), control should be performed so that, as illustrated in (c) of FIG. 9, an applied voltage value itself is not changed but a frequency is increased, compared with (b) of FIG. 9. On the contrary, under a low speed condition (for example, 83.5 mm/s), the control should be performed so that, as illustrated in (a) of FIG. 9, the applied voltage value itself is not changed but the frequency is decreased, compared with (b) of FIG. 9.

(Control in Case where Device Characteristic Changes)

Regarding a control that is performed by the voltage controlling section 33, the following explains a case when life deterioration occurs, that is, when a device characteristic changes with time.

Due to long-term use, the ion generating element 1 is deteriorated by, for example, deterioration of the dielectric body 21, adhesion of a discharge product, or abrasion of each electrode. This deteriorates discharge performance of the ion generating element 1. In case where the deterioration is relatively light, a necessary amount of ions can be generated by increasing a frequency of the applied voltage. However, in case where the applied voltage itself is set to a large voltage at an initial stage of deterioration, that is, at an early stage of use, the ion generating element 1 may be electrically damaged. This may accelerate deterioration of the ion generating element 1. However, when an operating period lengthens and a degree of deterioration progresses, discharge may not be stable at a same applied voltage value. In such a case, it is necessary to increase the applied voltage value itself so that discharge becomes easy to occur.

Therefore, in the present embodiment, operating period information is acquired and a frequency of the applied voltage is increased according to an increase in the operating period. When the frequency becomes not less than a predetermined value, a maximum value of an absolute value of the application voltage is increased. The operating period information can be acquired from, for example, a result of measuring an accumulated operating period or a result of measuring an accumulated number of sheets printed.

An arrow of life correction in FIG. 5 illustrates the above correction method. Here, one reason for increasing the frequency up only to a predetermined frequency is limitation from performance of the high voltage power source. That is, in case where the high voltage power source is made to handle high frequencies, cost and space increase. Moreover, in view of a rise characteristic of a voltage, it becomes impossible to provide a desired applied voltage waveform because rounding of waveform becomes significant at high frequencies. Therefore, according to a characteristic of the high voltage power source 32 that is employed, a frequency up to which the frequency correction is performed should be appropriately set. Further, a frequency up to which the frequency correction is performed and how voltage correction is performed differ depending on a characteristic of a device (charging device) that is employed. Therefore, the frequency up to which the frequency correction is performed and how voltage correction is performed should be set as appropriate according to life duration or a characteristic of the device.

The explanation above explains control at the time when various conditions at the time of printing changes, a movement speed of a charge receiving material changes, and life deterioration occurs. However, it is clear that the controls explained above may be used in appropriately arranged combination.

Here, the voltage controlling section 33 of the second pre-transfer charging device 3 may be constituted by hardware logic or may be realized by software by using a CPU in the following manner. That is, the second pre-transfer charging device 3 includes a CPU (central processing unit) that executes the order of a control program for realizing the aforesaid functions, ROM (read only memory) that stores the control program, RAM (random access memory) that develops the control program in an executable form, and a storage device (storage medium), such as memory, that stores the control program and various types of data therein. With this arrangement, the object of the present invention is realized by a predetermined storage medium. The storage medium stores, in a computer-readable manner, program codes (executable code program, intermediate code program, and source program) of the control program of the second pre-transfer charging device 3 of the present invention, which is software for realizing the aforesaid functions. The storage medium is provided to the second pre-transfer charging device 3. With this arrangement, the second pre-transfer charging device 3 (alternatively, CPU or MPU) as a computer reads out and executes program code stored in the storage medium provided.

The storage medium may be tape based, such as a magnetic tape or cassette tape; disc based, such as a magnetic disk including a Floppy® disc and hard disk and optical disk including CD-ROM, MO, MD, DVD, and CD-R; card based, such as an IC card (including a memory card) and an optical card; or a semiconductor memory, such as a mask ROM, EPROM, EEPROM, and a flash ROM.

Further, the second pre-transfer charging device 3 of the present invention may be arranged so as to be connectable to a communications network so that the program code is supplied to the second pre-transfer charging device 3 through the communications network. The communications network is not to be particularly limited. Examples of the communications network include the Internet, intranet, extranet, LAN, ISDN, VAN, CATV communications network, virtual private network, telephone network, mobile communications network, and satellite communications network. Further, a transmission medium that constitutes the communications network is not particularly limited. Examples of the transmission medium include (i) wired lines such as IEEE 1394, USB, power-line carrier, cable TV lines, telephone lines, and ADSL lines and (ii) wireless connections such as IrDA and remote control using infrared light, Bluetooth®, 802.11, HDR, mobile phone network, satellite connections, and terrestrial digital network. Note that the present invention can be also realized by the program codes in the form of a computer data signal embedded in a carrier wave which is embodied by electronic transmission.

The explanation above explains an arrangement of a charging device of the present invention and a control method of the charging device by using the second pre-transfer charging device 3. In case where the charging device of the present invention is used as the first pre-transfer charging device 2 or the latent image charging device 4, an arrangement and a control method thereof are basically the same as those of the second pre-transfer charging device 3. However, while a charge receiving material is a toner image on the intermediate transfer belt 15 in a case where the charging device of the present invention is used as the second pre-transfer device 3, a charge receiving material is a photosensitive drum 7 in a case where the charging device of the present invention is applied to a latent image charging device 4. Further, In case where the charging device of the present invention is applied to the first pre-transfer charging device 2, a charge receiving material becomes a toner image on the photosensitive drum 7. Furthermore, the counter electrode 31 is not provided in the first pre-transfer charging device 2 and the latent image charging device 4. In addition, as explained above, in the case of the latent image charging device 4, a grid electrode may be provided between the latent image charging device 4 and the photosensitive drum 7.

As mentioned above, the charging device of the present invention in which a discharge electrode and an inductive electrode are provided so as to sandwich a dielectric body and be opposed to each other and which charging device charges a charge receiving material by using ions that are extracted by applying an alternate voltage between the discharge electrode and the inductive electrode so as to cause creeping discharge, the charging device includes: a state information acquisition section acquiring a state information indicative of a state in which the charging device is used; and a voltage control section setting or changing, according to the information acquired by the state information acquisition section, a condition of an applied voltage that is an alternating voltage to be applied between the discharge electrode and the inductive electrode.

According to the arrangement, in accordance with state information of the charging device, an applied voltage to be applied between the discharge electrode and the inductive electrode can be set or changed. Accordingly, in a case where discharge is difficult to occur and an amount of ion generated decreases, for example, in a high humidity environment condition or in a state where each electrode is deteriorated with time, an amount of ions necessary for charging in such an occasion can be supplied by changing the applied voltage according to the case. Moreover, an amount of ions supplied per unit time needs to be changed depending on a printing mode of an image forming apparatus including the charging device, particularly when a change in the speed occurs. Even in this case, the above arrangement of the present invention makes it possible to perform an operation capable of supplying a necessary amount of ions. Therefore, an amount of ions necessary for charging can be always supplied.

Examples of the state information of the charging device are a temperature and a humidity surrounding the charging device, an operating period of the charging device, a movement speed of a charge receiving material that the charging device charges. However, the state information may be any information as long as the information is indicative of a state in which the charging device is used.

In the charging device of the present invention, in case where the state information acquisition section detects and acquires, as state information, a temperature and a humidity of an environment where the charging device is used, the voltage control section may set or change a maximum value of an absolute value of the applied voltage according to the temperature and humidity.

According to the arrangement, based on the temperature and humidity of the environment where the charging device is used, a maximum value of the absolute value of the applied voltage can be set or changed. Therefore, even when the temperature and humidity of the environment in which the charging device is used change, a necessary amount of ions can be stably supplied by correspondingly changing a condition of the applied voltage.

In a high humidity environment, discharge may not become stable unless a value of an applied voltage itself is increased. However, under a condition in which discharge is hard to occur, the amount of ions is hard to increase even at an increased frequency. Here, although an increased applied voltage tends to increase an amount of ozone generated, ozone is hard to be generated in a high humidity environment. Therefore, the arrangement above of the present invention does not become a problem in practice. On the other hand, discharge is easy to occur in a low humidity condition and ozone is easily generated. However, by decreasing the applied voltage, the arrangement above of the present invention can supply an appropriate amount of ions and decrease an amount of ozone generated.

In the charging device of the present invention, the charge receiving material moves with respect to the charging device. Accordingly, when the state information acquisition section is means to acquire a movement speed of the charge receiving material as the state information, the voltage control section may set or change a frequency of the applied voltage in accordance with the movement speed.

Depending on the movement speed of the charge receiving material, an ion current value (an amount of ions supplied per unit time) necessary to supply a predetermined amount of electric charge varies. The amount of ions supplied can be controlled by changing the applied voltage (applied voltage value itself). However, element deterioration easily progresses when the applied voltage is increased. Moreover, when the applied voltage is decreased, discharge itself may become unstable. However, in the charging device of the present invention, the above arrangement makes it possible to set or change a frequency of the applied voltage according to movement speed information of the charge receiving material. Therefore, under the same environment condition or the same use time condition (the same operating period), an amount of ions supplied can be controlled by changing a frequency at the same applied voltage. Therefore, ions can be stably generated. Further, unnecessary deterioration can be suppressed. This contributes to extension of life duration of the charging device.

In the charging device of the present invention, when the state information acquisition section is means to acquire operating period information of the charging device as the state information, the voltage controlling section may increase a frequency of the applied voltage in accordance with increase in an operating period of the charging device. Further, the voltage controlling section may increase a maximum voltage of an absolute value of the applied voltage in a case where the frequency becomes equal to or a more than a predetermined value.

According to the arrangement, in accordance with the operating period information of the charging device, a frequency of the applied voltage is increased in a case where the operating period increases. When this frequency becomes equal to or more than a predetermined value, a maximum value of an absolute value of the applied voltage is increased. An example of the operating period information is information utilizing an accumulated operating period or the number of printed sheet of the charging device or the image forming apparatus to which the charging device is attached.

Here, in order to prevent deterioration (life deterioration) due to operation of the device, it is preferable that the amount of ions is increased by increasing the frequency under a condition where discharge is performed stably and, then, after the frequency reaches an upper limit of a setting of the frequency, the amount of ions generated is corrected by increasing the applied voltage. This is because an unnecessary increase of the applied voltage could reduce the life duration of the device. The charging device of the present invention, as in the above arrangement, first increases the frequency, and then increases an applied voltage at the time when stable discharge with the use of a conventional applied voltage becomes impossible due to deterioration. Therefore, the charging device of the present invention is effective in extending life duration of the device.

The image forming apparatus of the present invention includes one of the charging devices above as a charging device for charging an electrostatic latent image bearing member.

By using the charging device of the present invention as a device for charging the electrostatic latent image bearing member, the electrostatic latent image bearing member can be appropriately charged at a stable charging amount. Moreover, the charging device of the present invention can provide a compact image forming apparatus because the charging device of the present invention employs a creeping discharge system.

Moreover, an image forming apparatus of the present invention includes any one of the charging devices as a charging device for pre-transfer charging in which electric charge is given to toner held on an image bearing member.

By employing the charging device of the present invention as a charging device for pre-transfer charging, toner before transfer can be preferably and appropriately charged. This can improve transfer efficiency and transfer uniformity. Further, the charging device of the present invention is compact, employing a creeping discharge system. Accordingly, charging of toner before transfer can be performed in a limited space and a size of the image forming apparatus can be reduced.

A control method of a charging device according to the present invention in which a discharge electrode and an inductive electrode are provided so as to sandwich a dielectric body and be opposed to each other and which charging device charges a charge receiving material by using ions extracted by applying an alternating voltage between the discharge electrode and the inductive electrode so as to cause creeping discharge, the control method includes the steps of: acquiring state information concerning a state of the charging device; and controlling a voltage by setting or changing, according to the information obtained in the step of acquiring the state information, a condition of an applied voltage that is an alternating voltage to be applied between the discharge electrode and the inductive electrode.

According to the control method above, even in a state where discharge is hard to occur, a necessary amount of ions can be stably supplied. Therefore, this control method can provide the substantially the same effect as the charging device of the present invention.

Note that the above charging device may be realized by a computer. In this case, the scope of the present invention includes a control program causing a computer to serve as a voltage control section of any one of the charging devices or a computer-readable storage medium recording the control program. The control program and the computer-readable storage medium provide substantially the same effect as the charging device of the present invention.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below. Moreover, even when an arrangement has numeral values that are out of the numeral value range described in the present specification, the present invention includes such an arrangement as long as the arrangement is in the scope that is reasonable according to the object of the present invention.

The present invention is applicable to a charging device in an image forming apparatus employing an electrophotographic printing method, which charging device carries out, for example, a pre-transfer charging for charging before transfer of a toner image that is formed on an image baring member such as a photoreceptor or an intermediate transfer member, latent image charging for charging the photoreceptor, or a preliminary charging of toner for assisting toner charging in a developing device.

What is claimed is:

1. A charging device in which a discharge electrode and an inductive electrode are provided so as to sandwich a dielectric body and be opposed to each other and which charging device charges a charge receiving material by using ions that are extracted by applying an alternating voltage between the discharge electrode and the inductive electrode so as to cause creeping discharge, the charging device comprising:

a period acquisition section acquiring operating period information of the charging device; and a voltage control section increasing, according to the operating period information of the charging device which operating period information is acquired by the period acquisition section, (i) a frequency of an applied voltage that is the alternating voltage applied between the discharge electrode and the inductive electrode, in accordance with an increase in the operating period of the charging device, and (ii) a maximum value of an absolute value of the applied voltage in a case where the frequency becomes equal to or more than a predetermined value.

2. The charging device as set forth in claim 1, wherein:

the period acquisition section acquires, as the operating period information, at least one of an accumulated operating period of the charging device and an accumulated number of printed sheet of the image forming apparatus including the charging device.

3. An image forming apparatus including a charging device as set forth in claim 1 as a charging device that charges an electrostatic latent image bearing member.

4. An image forming apparatus including a charging device as set forth in claim 1 as a charging device for pre-transfer charging in which an electric charge is given to toner that is held on an image bearing member.

5. A control method of a charging device in which a discharge electrode and an inductive electrode are provided so as to sandwich a dielectric body and be opposed to each other and which charging device charges a charge receiving material by using ions extracted by applying an alternating voltage between the discharge electrode and the inductive electrode so as to cause creeping discharge, the control method comprising the steps of:

acquiring operating period information of the charging device; and controlling a voltage by increasing, according to the operating period information of the charging device which operating period information is acquired in the step of acquiring the operating period information, (i) a frequency of an applied voltage that is the alternating voltage applied between the discharge electrode and the inductive electrode, in accordance with an increase in the operating period of the charging device, and (ii) a maximum value of an absolute value of the applied voltage in a case where the frequency becomes equal to or more than a predetermined value.

6. A computer-readable medium containing a control program consisting of a set of instructions executable on a computer for causing the computer to serve as a voltage control section of a charging device as set forth in claim 1.

* * * * *